US006772967B1

(12) United States Patent
Bontems

(10) Patent No.: US 6,772,967 B1
(45) Date of Patent: Aug. 10, 2004

(54) MISTING NOZZLE

(76) Inventor: Thomas A. Bontems, 1909 E. Palmcroft Dr., Tempe, AZ (US) 85282

( * ) Notice: Subject to any disclaimer, the term of this patent is extended or adjusted under 35 U.S.C. 154(b) by 0 days.

(21) Appl. No.: 10/131,450

(22) Filed: Apr. 22, 2002

(51) Int. Cl.[7] ..... B05B 1/00; B05B 1/34

(52) U.S. Cl. ..... 239/589; 239/461; 239/463; 239/469; 239/470; 239/482; 239/490; 239/491; 239/493; 239/494

(58) Field of Search ..... 239/461, 463, 239/468, 469, 470, 474, 482, 483, 488, 490, 491, 493, 494, 496, 589

(56) References Cited

U.S. PATENT DOCUMENTS 2,044,694 A * 6/1936 Huss ..... 239/493
2,044,696 A * 6/1936 Huss ..... 239/391
2,120,611 A * 6/1938 Huss ..... 239/493
2,248,728 A * 7/1941 Strosk ..... 239/491
2,562,731 A * 7/1951 Murphy ..... 239/493
2,762,657 A * 9/1956 Wilson ..... 239/493
3,053,462 A * 9/1962 Schloz ..... 239/465
3,726,482 A * 4/1973 Heinrichs ..... 239/467
4,142,682 A * 3/1979 Bowen ..... 239/488
4,320,875 A * 3/1982 Sutter ..... 239/462
5,934,569 A * 8/1999 Soule et al. ..... 239/468

* cited by examiner

*Primary Examiner*—Robin O. Evans
(74) *Attorney, Agent, or Firm*—Parsons & Goltry; Robert A. Parsons; Michael W. Goltry

(57) ABSTRACT

A misting nozzle includes a nozzle body defining a conduit with a fluid inlet and a fluid outlet end. The nozzle also includes an aperture member having an opening therethrough with an aperture at one end. The opening is designed to receive the fluid outlet end therein. External threads on the nozzle body and mating internal threads in the opening releasably attach the aperture member to the nozzle body. A circumferentially extending surface is formed on the nozzle body adjacent the outlet end so as to abut a mating surface in the opening of the aperture member to prevent fluid flow between the fluid outlet and the aperture. Offset slots extend between the mating surfaces to provide fluid flow and are positioned to impart turbulence to the fluid prior to flowing through the aperture.

11 Claims, 2 Drawing Sheets

MISTING NOZZLE

FIELD OF THE INVENTION

This invention relates to misting nozzles.

More particularly, the present invention relates to misting nozzles which can be broken down for cleaning.

BACKGROUND OF THE INVENTION

In many geographical areas, such as dry or desert conditions, high air temperatures can be alleviated by creating a mist of water, which cools the air as it evaporates. The water is turned into a mist by passing it through very fine nozzles at relatively high pressures. One problem with this system is that the fine nozzles are easily clogged by foreign particles or by deposits left by evaporating water. Generally, in prior art nozzles the components are press-fit together and once foreign material or deposits from evaporation clog the nozzles, they must be discarded and replaced with entirely new nozzles.

I Also, prior art nozzles were constructed with a floating barrel that is loosely held in the body to direct water from the input to a spray aperture. When water is applied, the floating barrel may not seat properly and will be axially misaligned with the aperture so that water is not directed properly to the aperture and a uniform angular distribution does not occur.

Another problem with this system is the fact that the size of the nozzle aperture dictates the amount of water pressure and flow that must be used to create the mist. Water flow through the nozzle is very difficult to control since the amount of water flowing is directly dependent upon the size of the nozzle aperture. If the nozzles openings or apertures are too large, much of the water is wasted by producing droplets that are too large to efficiently evaporate. However, if the nozzle openings or apertures are too small they clog more often causing undue maintenance. Also, nozzles with very small aperture sizes are more difficult to manufacture.

It would be highly advantageous, therefore, to remedy the foregoing and other deficiencies inherent in the prior art.

Accordingly, it is an object the present invention to provide a new and improved misting nozzle.

Another object of the present invention is to provide a new and improved misting nozzle that can be easily cleaned, generally without removing the nozzle from the misting system.

And another object of the present invention is to provide a new and improved misting nozzle that produces mist more efficiently without requiring excessive water pressure or nozzle aperture sizes.

Still another object of the present invention is to provide a new and improved misting nozzle that is easy to manufacture and install.

SUMMARY OF THE INVENTION

Briefly, to achieve the desired objects of the present invention in accordance with a preferred embodiment thereof, provided is a misting nozzle including a nozzle body defining a conduit with a fluid inlet and a fluid outlet end. An aperture member has an opening therethrough and defining an aperture at one end. Apparatus is provided for detachably attaching the aperture member adjacent the outlet end of the nozzle body so that fluid flows from the conduit into the opening and through the aperture. Selfaligning fluid restricting apparatus is positioned in the fluid flow so as to impart a turbulence to the fluid prior to flowing through the aperture. In the preferred embodiment the fluid restricting apparatus includes a pair of offset slots positioned in the fluid flow.

BRIEF DESCRIPTION OF THE DRAWINGS

The foregoing and further and more specific objects and advantages of the invention will become readily apparent to those skilled in the art from the following detailed description of a preferred embodiment thereof, taken in conjunction with the drawings in which.

DETAILED DESCRIPTION OF A PREFERRED EMBODIMENT

Figure 1:
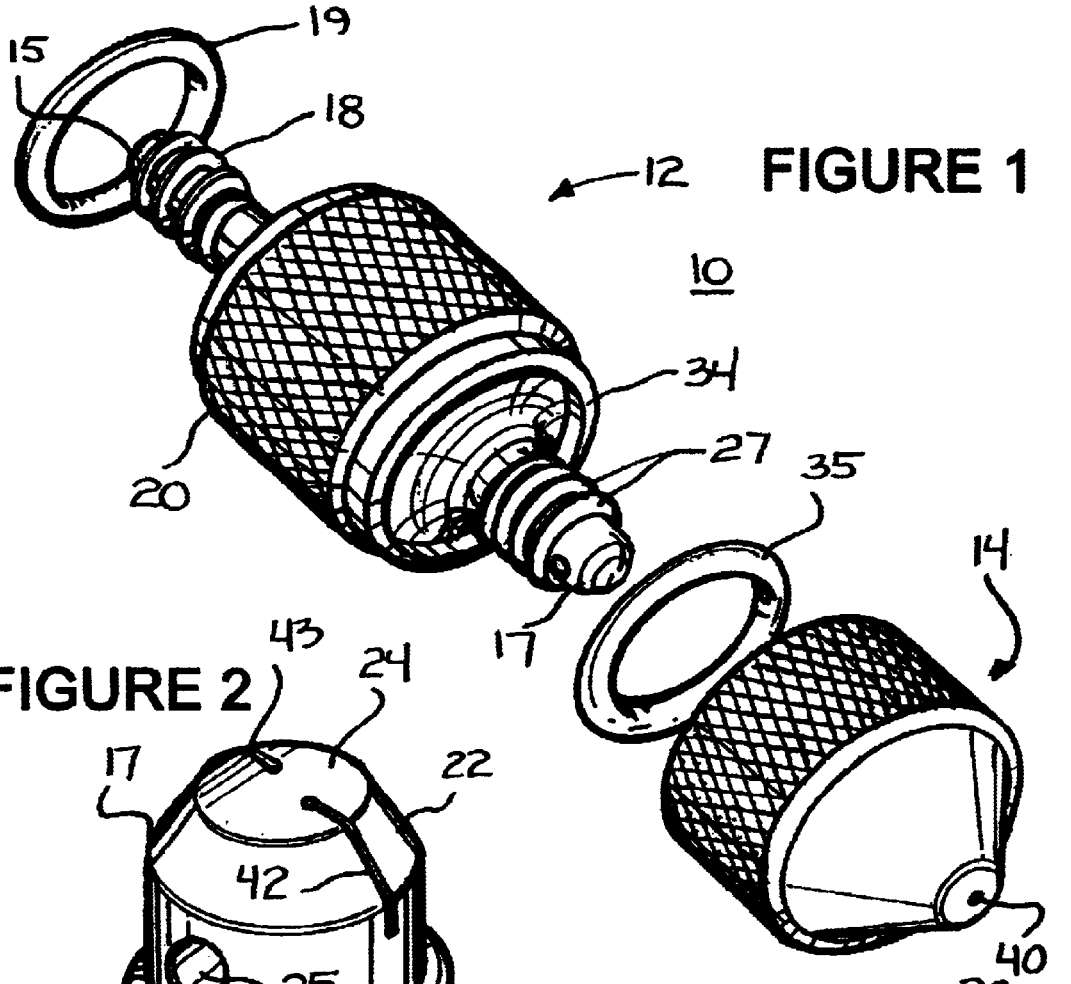
FIG. 1 is an exploded isometric view of a misting nozzle in accordance with the present invention.

Turning now to the drawings in which like reference characters indicate corresponding elements throughout the several views, attention is directed to FIG. 1, which illustrates a misting nozzle 10 in accordance with the present invention. Misting nozzle 10 includes a nozzle body 12 and an aperture member 14. Nozzle body 12 has a water inlet end 15 and an emission end 17 with a water conduit extending longitudinally therebetween. Inlet end 15 is constructed similar to a standard misting nozzle and includes outer threads 18 designed to be engaged in a standard misting system. An O-ring 19 is included to fit between misting nozzle 10 and the misting system to prevent leakage. Nozzle body 12 includes a portion 20 with an enlarged diameter and a knurled surface for easy handling and installation. It will of course be understood that misting nozzle 10 can include other apparatus for attachment to a standard misting system or a water source, such as barbed connectors, etc.

Figure 4:
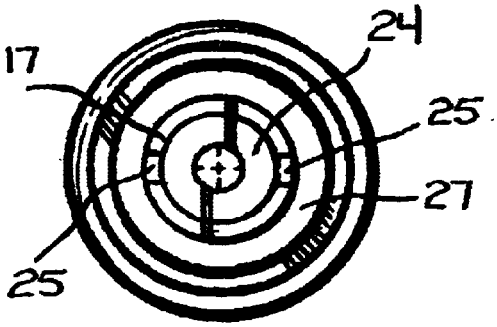
FIG. 4 is an end view of the nozzle body, from the emission end.
Figure 5:
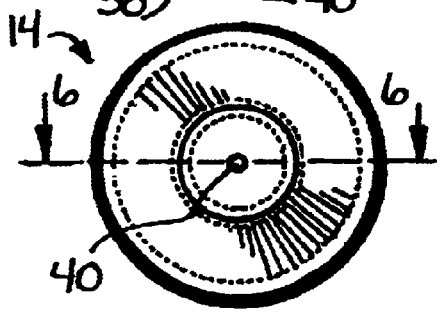
FIG. 5 is an end view of the misting aperture member from the emission end.
Figure 7:
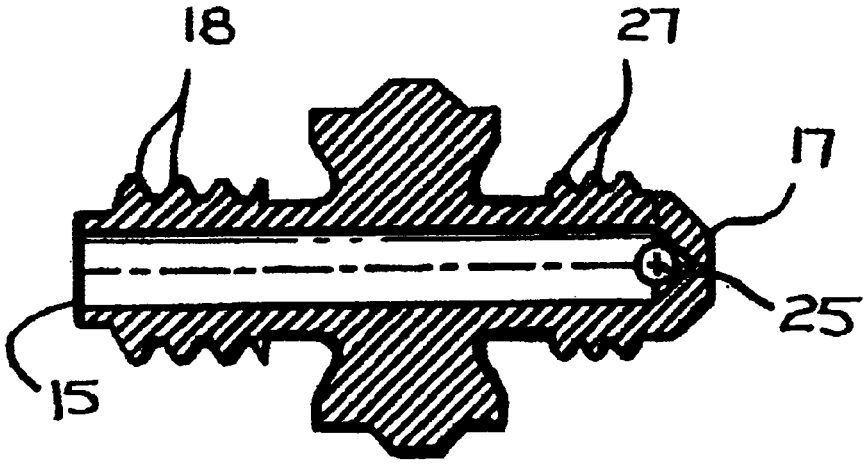
FIG. 7 is a sectional view of the nozzle body.

Emission end 17 of nozzle body 12 is tapered inwardly at a portion 22 and ends in a flat transverse surface 24. A bore is provided radially through emission end 17 in communication with the inner conduit to form openings 25 on either side of emission end 17 (see FIGS. 4 and 7) to allow the flow of water from inlet end 15 radially outwardly from emission end 17. Threads 27 are formed in the outer surface of emission end 17 of nozzle body 12 for receiving aperture member 14 threadedly engaged thereon. It will of course be understood that aperture member 14 is threadedly engaged on nozzle body 12 in this embodiment for convenience and other attachment methods and apparatus (e.g. bayonet connectors, etc.) can be used if desired.

Aperture member 14 has an elongated opening 30 formed therein with internal threads for receiving emission end 17 of nozzle body 12 therein. The inlet end of opening 30 has a radially enlarged portion 32 constructed to receive a longitudinally extending collar 34 on nozzle body 12. An O-ring 35 is provided to fit between aperture member 14 and collar 34 within portion 32 of opening 30 to prevent leakage of water. Aperture member 14 has an enlarged diameter with a knurled outer circumference for easy handling. With aperture member 14 threadedly engaged on nozzle body 12, knurled portion 20 and the knurled outer circumference of aperture member 14 form a substantially continuous surface. Here it should be noted that aperture member 14 can be conveniently unthreaded from nozzle body 12, for cleaning or the like, without removing nozzle body 12 from the misting system.

Figure 6:
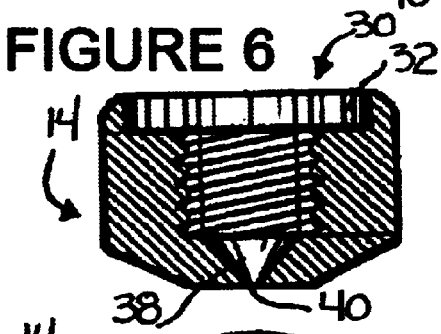
FIG. 6 is a sectional view as seen from the line 6—6 in FIG. 5.

As can be seen most easily in FIG. 6, opening 30 in aperture member 14 includes a conically inwardly tapering portion 38, adjacent the outlet end of aperture member 14. Portion 38 ends in an outlet misting aperture 40 through the outlet end of aperture member 14.

Figure 2:
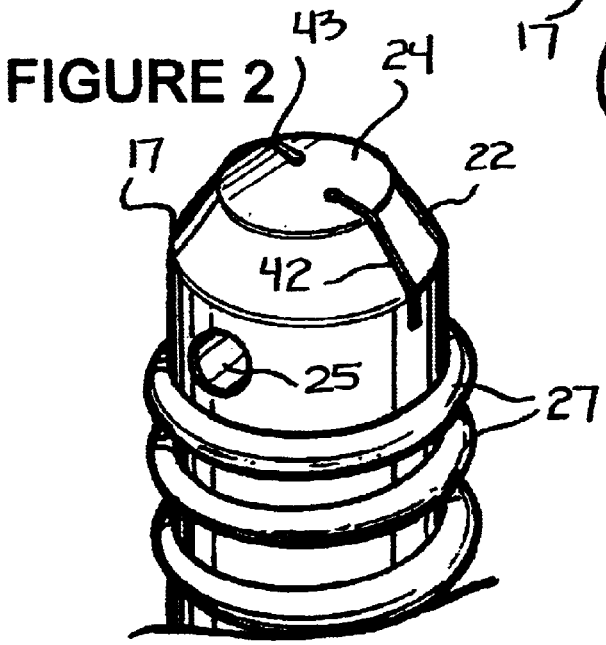
FIG. 2 is an enlarged isometric view from the emission end of the nozzle body, portions thereof removed.
Figure 3:
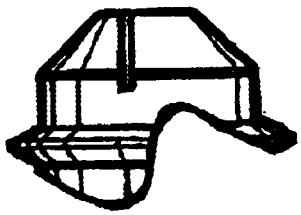
FIG. 3 is a side view of the emission end of the nozzle body, portions thereof broken away.

Referring additionally to FIGS. 2 and 3, it can be seen that a pair of longitudinally extending slots 42 and 43 are formed in the outer surface of emission end 17 of nozzle body 12. Slot 42 extends along one side of emission end 17 from a point between openings 25, across tapered portion 22, and ends in flat surface 24. Slot 43 extends along the opposite side of emission end 17 from a point between openings 25, across tapered portion 22, and ends in flat surface 24. The inlet end of slot 42 is positioned closer to one of openings 25 and the inlet end of slot 43 is positioned closer to the other opening 25 so that they are approximately 180 degrees apart but offset from the radius of emission end 17, as can best be seen in FIG. 4. Also the outlet ends of slots 42 and 43 are spaced from the longitudinal axis and are offset from the radius.

With aperture member 14 threadedly engaged on nozzle body 12, collar 34 and O-ring 35 aid in ensuring proper alignment of aperture member 14 on nozzle body 12 so that aperture 40 is axially aligned with emission end 17. With aperture member 14 properly aligned on nozzle body 12, outer tapered portion 22 of emission end 17 fits tightly against inner tapered portion 38 of aperture member 14 substantially preventing the flow of water from openings 25 to aperture 40. However, water can flow from openings 25 through slots 42 and 43 to aperture 40. Because slots 42 and 43 are offset, the water flowing toward aperture 40 is directed into a clockwise whirl or spin. The spin of the water as it enters aperture 40 from slots 42 and 43 produces a turbulence that greatly enhances the misting action. While slots 42 and 43 are illustrated as extending generally longitudinally in this embodiment, it will be understood that other embodiments may be devised for offset slots that will impart a similar turbulence to fluid flowing into aperture 40. For example, slots may be provided that follow a helical or partially circular path with the ends discharging water at an angle to aperture 40. Such slots have the disadvantage, however, that they are somewhat harder to form in the metal surfaces.

Also, slots 42 and 43 provide a convenient apparatus for adjusting the amount of water flowing through misting nozzle 10. That is, rather than changing the size of aperture 40 to change the amount of water flow, the size of slots 42 and 43 can be changed. Since slots 42 and 43 are internal, they are not as likely to be hampered by evaporation residue. Further, because there are two slots there is less chance of a complete obstruction by foreign particles. It will of course be understood that two slots are illustrated and described in this embodiment for convenience and any desired number of slots can be provided. It should also be noted that various aperture members 14 can be provided with different sized holes to provide different amounts and angles of spray. Thus, by simply changing aperture member 14 different flows and spray patterns can be achieved.

Accordingly, a new and improved misting nozzle has been described which is constructed so that it can be easily cleaned without removing the nozzle from the entire misting system. Further, components of the new and improved misting nozzle are self-aligning so that misaligned components are avoided. The new and improved misting nozzle produces mist more efficiently without requiring excessive water pressure or nozzle aperture sizes and is easy to manufacture and install. Because of the novel aligned components producing the turbulent action within the aperture member, water is more consistently broken into smaller particles of mist as the water exits the aperture. Further, aperture sizes can be easily and conveniently changed by simply changing the aperture member.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

What is claimed is:

1. A misting nozzle comprising:

a nozzle body defining a conduit with a fluid inlet end and a fluid cutlet end;

attachment apparatus carried by the fluid inlet end for detachably attaching the nozzle body into a misting system;

an aperture member having an opening therethrough and defining an aperture at one end;

apparatus detachably attaching the aperture member adjacent the outlet end of the nozzle body so that fluid flows from the conduit into the opening and through the aperture;

the nozzle body includes an enlarged portion with a textured outer surface for gripping and the aperture member includes an enlarged outer surface forming a substantially continuous surface with the enlarged portion of the nozzle body; and self-aligning apparatus positioned in the fluid flow so as to impart a turbulence to the fluid prior to flowing through the aperture.

2. A misting nozzle as claimed in claim 1 wherein the apparatus detachably attaching the aperture member to the nozzle body includes threads.

3. A misting nozzle as claimed in claim 1 wherein the self-aligning apparatus positioned in the fluid flow includes at least one longitudinally extending slot positioned in the fluid flow.

4. A misting nozzle as claimed in claim 3 wherein the longitudinally extending slot is offset to impart a whirling motion to fluid flowing from the conduit to the aperture.

5. A misting nozzle as claimed in claim 4 wherein the nozzle body includes a circumferentially extending surface that abuts a mating surface in the opening of the aperture member to substantially limit fluid flow therebetween, and the slot extends between the surfaces to conduct fluid therethrough, the surfaces being positioned between the conduit fluid outlet end and the aperture in the aperture member.

6. A misting nozzle as claimed in claim 3 wherein the apparatus positioned in the fluid flow includes two longitudinally extending slots positioned approximately 180 degrees apart around the circumference of the conduit fluid outlet end of the nozzle body and offset from a radius of the fluid outlet end.

7. A misting nozzle as claimed in claim 1 further including a seal member carried by the nozzle body proximate the fluid outlet end, sealing the nozzle body to the aperture member.

8. A misting nozzle as claimed in claim 1 further including a sealed member carried by the nozzle body proximate the fluid inlet end for sealing the nozzle body to the misting system.

9. A misting nozzle comprising:

a nozzle body defining a conduit with a fluid inlet end and a fluid outlet end, the conduct including a fluid outlet adjacent the fluid outlet end;

attachment apparatus carried by the fluid inlet end detachably attaching the nozzle body into a misting system;

an aperture member having an opening therethrough and defining an aperture at one end, the opening in the aperture member being designed to receive the fluid outlet end of the nozzle body therein;

the nozzle body having external threads on the outer surface and the aperture member having mating internal threads in the opening for detachably attaching the aperture member to the nozzle body so that fluid flows from the fluid outlet in the conduit into the opening;

the nozzle body includes an enlarged portion with a textured outer surface for gripping and the aperture member includes an enlarged outer surface forming a substantially continuous surface with the enlarged portion of the nozzle body;

a circumferentially extending surface formed on the nozzle body adjacent the outlet end that abuts a mating surface in the opening of the aperture member, the mating surfaces being positioned to substantially limit fluid flow between the fluid outlet of the nozzle body and the aperture; and offset slots extending between the mating surfaces to provide fluid flow between the fluid outlet of the nozzle body and the aperture, the slots being positioned in the fluid flow so as to impart a turbulence to the fluid prior to flowing through the aperture.

10. A misting nozzle as claimed in claim 9 further including a seal member carried by the nozzle body proximate the fluid inlet end, sealing the nozzle body to the misting system.

11. A misting nozzle as claimed in claim 9 further including a seal Member carried by the nozzle body proximate the fluid outlet end, sealing the nozzle body to the aperture member.

* * * * *